US011002446B2

(12) United States Patent
Burns et al.

(10) Patent No.: US 11,002,446 B2
(45) Date of Patent: May 11, 2021

(54) COMBUSTION KILN SYSTEM AND METHOD OF OPERATING THE SAME

(71) Applicant: Clean Thermodynamic Energy Conversion Ltd, Newhaven (GB)

(72) Inventors: Michael Alan Burns, Seaford (GB); Paul Andrew Burns, Seaford (GB)

(73) Assignee: CLEAN THERMODYNAMIC ENERGY CONVERSION LIMITED, East Sussex (GB)

( * ) Notice: Subject to any disclaimer, the term of this patent is extended or adjusted under 35 U.S.C. 154(b) by 0 days.

(21) Appl. No.: 16/317,317

(22) PCT Filed: Jul. 10, 2017

(86) PCT No.: PCT/EP2017/067304
§ 371 (c)(1),
(2) Date: Jan. 11, 2019

(87) PCT Pub. No.: WO2018/011154
PCT Pub. Date: Jan. 18, 2018

(65) Prior Publication Data

US 2019/0316771 A1 Oct. 17, 2019

(30) Foreign Application Priority Data

Jul. 11, 2016 (GB) ..... 1611997

(51) Int. Cl.

| | |
|---|---|
| ***F23G 5/16*** | (2006.01) |
| ***F23H 7/08*** | (2006.01) |
| *F23G 5/46* | (2006.01) |

(52) U.S. Cl.
CPC ..... *F23G 5/16* (2013.01); *F23H 7/08* (2013.01); *F23G 5/46* (2013.01); *F23G 2201/10* (2013.01);
(Continued)

(58) Field of Classification Search
CPC .... F23G 5/05; F23G 5/28; F23M 5/08; F23M 5/085; F23M 5/00; F27B 3/225;
(Continued)

(56) References Cited

U.S. PATENT DOCUMENTS 3,321,845 A * 5/1967 Boron ..... F27D 15/022 34/164
4,091,748 A 5/1978 Mansfield
(Continued)

FOREIGN PATENT DOCUMENTS

CN 203404780 U 1/2014
GB 1 206 338 9/1970
(Continued)

OTHER PUBLICATIONS

International Search Report and Written Opinion for corresponding Patent Application No. PCT/EP2017/067304 dated Sep. 7, 2017.

*Primary Examiner* — Jason Lau
(74) *Attorney, Agent, or Firm* — Renner, Otto, Boisselle & Sklar, LLP

(57) ABSTRACT

A combustion kiln system, comprising: a pre-heating chamber which is supplied with waste product; and a combustion chamber which receives the waste product from the pre-heating chamber and in which the waste product is incinerated; wherein the pre-heating chamber heats the waste product to remove moisture from the waste product prior to transfer to the combustion chamber.

13 Claims, 4 Drawing Sheets

(52) U.S. Cl.
CPC .. *F23G 2203/101* (2013.01); *F23G 2203/803* (2013.01)

(58) Field of Classification Search
CPC .. F27B 3/205; F27B 13/14; F27B 9/20; F27B 9/243; F27B 17/0025; F27B 3/085; F27B 13/02; F27B 13/06; F27B 13/12; F27B 15/09; F27B 15/16; F27B 15/18; F27B 17/0016; F27B 17/0083; F27B 19/04; F27B 3/045; F27B 3/186; F27B 3/28; F27B 7/34; F27B 7/42; F26B 23/022; F26B 2200/18; F26B 23/028; F26B 23/001; F26B 23/02; F26B 25/005; F26B 19/005; F26B 21/06; F26B 11/028; F26B 2210/16; F26B 17/003; F26B 21/04; F26B 17/20; F26B 3/08; F26B 3/12; F26B 3/347; F26B 17/106; F26B 21/14; F26B 13/104; F26B 21/10; F26B 25/007; F26B 23/026; F26B 17/04; F26B 1/00; F26B 1/005; F26B 25/006; F26B 3/084; F26B 7/00; F26B 11/0445; F26B 17/16; F26B 2200/02; F26B 2200/24; F26B 25/12; F26B 3/00; F26B 15/00; F26B 3/205; F26B 3/343; F26B 11/0413; F26B 13/10; F26B 17/107; F26B 21/001; F26B 2210/12; F26B 23/024; F26B 23/10; F26B 3/082; F26B 9/06; F26B 11/04; F26B 11/0477; F26B 11/0481; F26B 17/10; F26B 17/102; F26B 17/122; F26B 17/1483; F26B 17/24; F26B 17/284; F26B 21/02; F26B 21/026; F26B 23/002; F26B 25/22; F26B 3/0926; F26B 3/283; F26B 3/305; F26B 11/16; F26B 11/181; F26B 11/22; F26B 13/003; F26B 13/186; F26B 15/085; F26B 15/12; F26B 15/14; F26B 17/02; F26B 17/101; F26B 17/103; F26B 17/14; F26B 21/00; F26B 21/004; F26B 21/08; F26B 21/12; F26B 2210/14; F26B 25/001; F26B 25/002; F26B 25/06; F26B 3/088; F26B 3/10; F26B 3/22; F26B 9/085; F26B 11/026; F26B 11/0409; F26B 11/044; F26B 11/0468; F26B 11/0472; F26B 11/08; F26B 13/005; F26B 15/18; F26B 17/005; F26B 17/008; F26B 17/08; F26B 17/104; F26B 17/105; F26B 17/126; F26B 17/1416; F26B 17/1433; F26B 17/22; F26B 17/26; F26B 21/002; F26B 21/006; F26B 21/083; F26B 21/145; F26B 2200/04; F26B 23/00; F26B 23/005; F26B 23/06; F26B 25/00; F26B 25/008; F26B 25/009; F26B 25/10; F26B 3/18; F26B 3/20; F26B 3/28; F26B 3/286; F26B 5/02; F26B 9/003; F26B 9/066

See application file for complete search history.

(56) References Cited

U.S. PATENT DOCUMENTS

| | | | | |
|---|---|---|---|---|
| 5,749,307 | A | 5/1998 | Okigami et al. | |
| 2003/0075086 | A1 | 4/2003 | Pallett | |
| 2005/0183642 | A1 * | 8/2005 | Basic, Sr. | F23G 5/444 110/224 |
| 2010/0122643 | A1 | 5/2010 | Cole et al. | |
| 2013/0186311 | A1 * | 7/2013 | Lin | F23L 9/02 110/228 |

FOREIGN PATENT DOCUMENTS

| | | | |
|---|---|---|---|
| JP | S59-125317 | | 7/1984 |
| JP | H08-327041 | | 12/1996 |
| JP | 09049621 | A * | 2/1997 |
| JP | H09-033017 | | 2/1997 |

* cited by examiner

COMBUSTION KILN SYSTEM AND METHOD OF OPERATING THE SAME

The present invention relates to a combustion kiln system for combustion of waste product, such as municipal solid waste (MSW) and processed waste, for example, refuse-derived waste (RDF), and in particular a system which generates a superheated fluid for driving one or more steam engines, and a method of operating such a combustion kiln system.

In one aspect the present invention provides a combustion kiln system, comprising: a pre-heating chamber which is supplied with waste product; and a combustion chamber which receives the waste product from the pre-heating chamber and in which the waste product is incinerated; wherein the pre-heating chamber heats the waste product to remove moisture from the waste product prior to transfer to the combustion chamber.

In another aspect the present invention provides a combustion kiln system, comprising: a combustion chamber in which waste product is incinerated; wherein the combustion chamber comprises a cavity, and a transfer mechanism which provides a grate at the floor of the combustion chamber and transfers waste product through a combustion zone, the transfer mechanism comprising at least one stepped assembly over which waste product is transferred, and the at least one stepped assembly comprising a plurality of steps which are arranged in downwardly-descending relation and a plurality of movable members which are movable reciprocally in relation to the steps to transfer waste product along and over the steps.

In a further aspect the present invention provides a method of incinerating waste product, comprising the steps of: pre-heating waste product in a pre-heating chamber; transferring the heated waste product to a combustion chamber; and incinerating the waste product in the combustion chamber; wherein the pre-heating chamber heats the waste product substantially to remove moisture from the waste product prior to transfer to the combustion chamber.

Preferred embodiments of the present invention will now be described hereinbelow by way of example only with reference to the accompanying drawings, in which.

Figure 1:
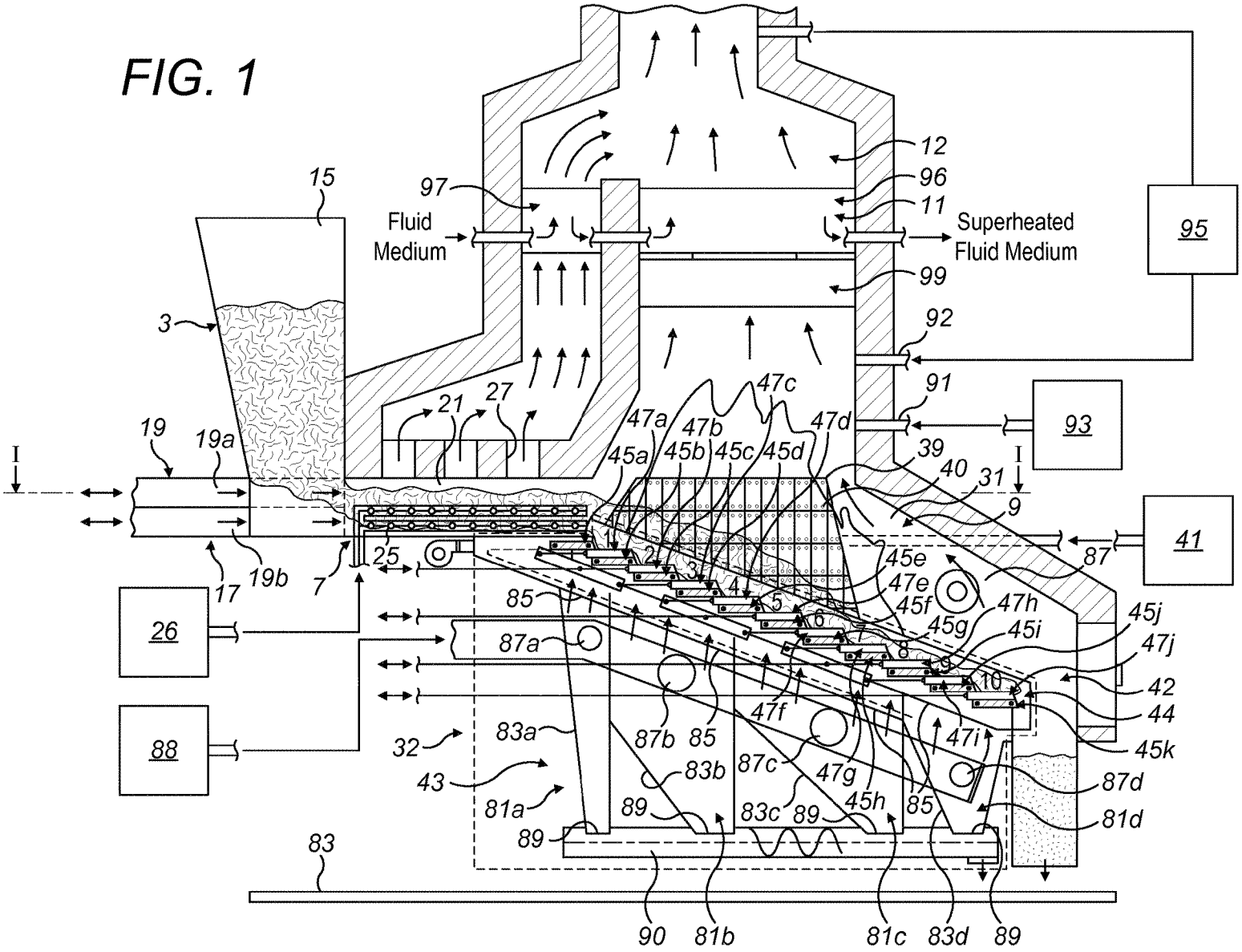
FIG. 1 illustrates a combustion kiln system in accordance with one embodiment of the present invention.
Figure 2:
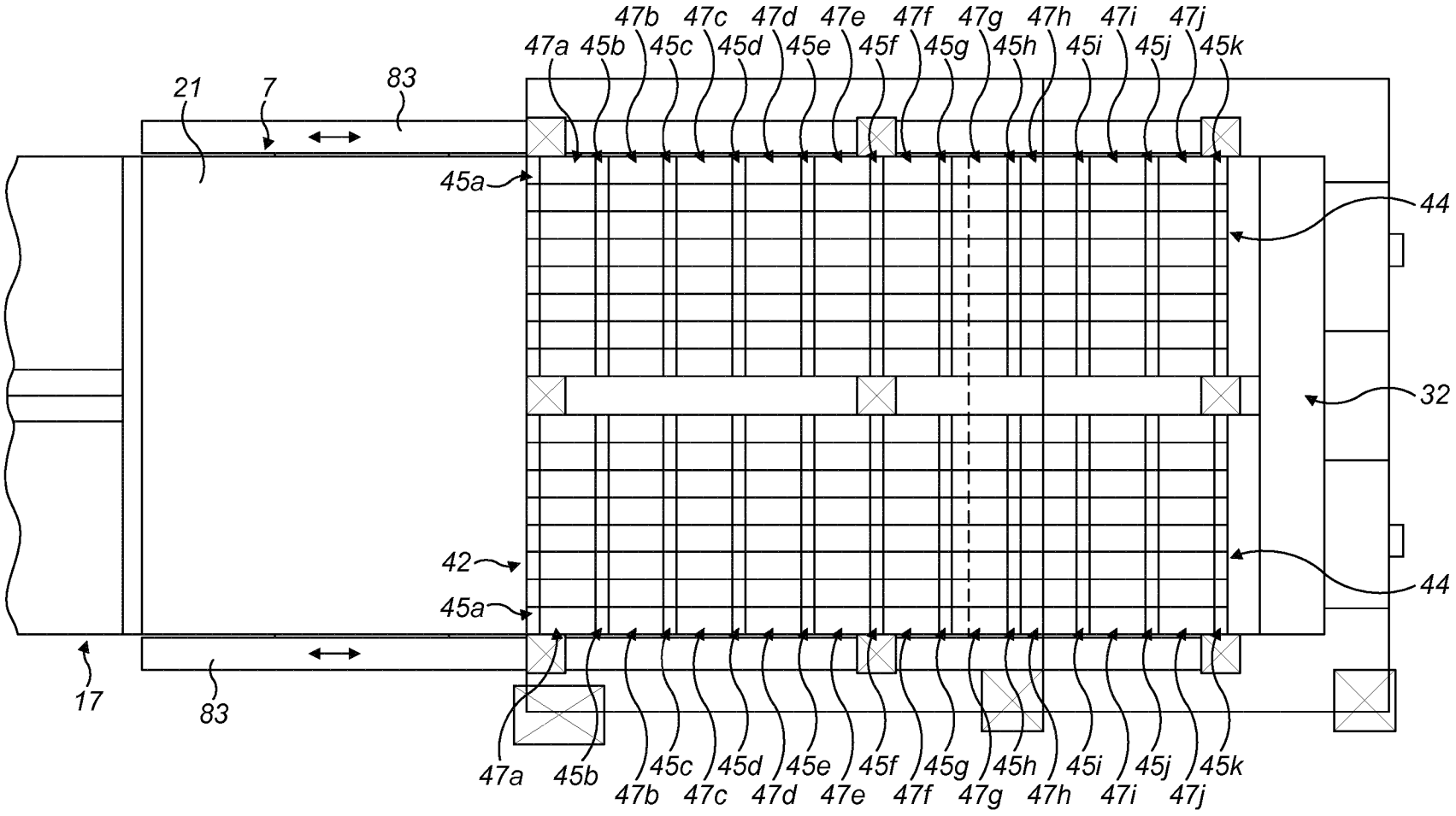
FIG. 2 illustrates a horizontal sectional view (along section I-I in FIG. 1) of the system of FIG. 1.

The combustion kiln system comprises a waste product supply 3 for supplying a waste product for combustion, a pre-heating chamber 7 which is supplied with the waste product from the waste product supply 3 and pre-heats the waste product, a main, combustion chamber 9 which receives pre-heated waste product from the pre-heating chamber 7 and in which the waste product is burnt to an ash residue, a post-combustion chamber 11 which receives hot gas from the combustion chamber 9, and a heat exchanger unit 12 which provides a superheated fluid medium.

In this embodiment the waste product is municipal solid waste (MSW) or processed waste, for example, refuse-derived waste (RDF).

The waste product supply 3 comprises at least one hopper 15 which contains waste product, and a feed mechanism 17 which feeds waste product from the at least one hopper 15 to the pre-heating chamber 7.

In this embodiment the waste product supply 3 comprises first and second hoppers 15.

In this embodiment the feed mechanism 17 comprises at least one ram 19 which is actuated by at least one actuator (not illustrated) reciprocally between a first, material-receiving position, in which waste product can fall from the at least one hopper 15 in front of the at least one ram 19, and a second, feed position, in which the waste product ahead of the at least one ram 19 is fed, here pushed, into an upstream end of the pre-heating chamber 7. With this action of the at least one ram 19, the feeding of fresh waste product into the pre-heating chamber 7 causes waste product at a downstream end of the pre-heating chamber 7 to be fed into an upstream end of the combustion chamber 9.

In this embodiment the feed mechanism 17 comprises first and second rams 19*a, b*, here arranged in parallel relation, which are operable independently of one another.

In this embodiment the pre-heating chamber 7 comprises an elongate cavity 21 along which waste product is displaced with operation of the feed mechanism 17.

In this embodiment the pre-heating chamber 7 includes a plurality of air inlets 25 through which heated ambient air is fed into the cavity 21 from an air source 26, and a plurality of vents 27 through which gas and steam is vented to atmosphere. With this configuration, the heated air from the air inlets 25 and heat from the combustion chamber 9 acts to heat the waste product within the pre-heating chamber 7.

In this embodiment the pre-heating chamber 7 is controlled such that an upstream region of the cavity 21 is maintained at a temperature of less than 600 C, which is sufficient for removal of moisture within the waste product, and the present inventors have recognized that the removal of moisture at a temperature of less than 600 C prevents the release of chlorides, and in particular HCL, which is detrimental to the complex stainless steel pipework of the main heat exchanger 93.

In this embodiment the pre-heating chamber 7 is controlled such that the level of moisture within the waste product is reduced to less than 10 wt %, optionally less than 8 wt %, optionally less than 5 wt %.

In this embodiment the combustion chamber 9 comprises a cavity 31, and a floor assembly 32 over which waste product is transferred.

In this embodiment the cavity 31 is lined at least on opposite side walls thereof with wear-resistant plates 39, which can withstand the high temperature environment.

In this embodiment the plates 39 each including apertures 40 through which air is delivered over a facing surface thereof from an air supply 41, so as to generate air flows at the opposite side walls which cools the side walls and provides air for combustion within the cavity 31.

In this embodiment the plates 39 are formed of high-temperature stainless steel.

In this embodiment the floor assembly 32 comprises a transfer mechanism 42 which provides a grate at the floor of the combustion chamber 9 and transfers waste product which is received from the pre-heating chamber 7 through a combustion zone, and an air supply unit 43 which supplies air to the combustion chamber 9 through the transfer mechanism 42.

In this embodiment the transfer mechanism 42 comprises at least one stepped assembly 44 over which waste product is transferred.

In this embodiment the transfer mechanism 42 comprises first and second stepped assemblies 44 which are arranged in adjacent, parallel relation.

In this embodiment the at least one stepped assembly 44 comprises a plurality of steps 45*a-k*, here of fixed position, which are arranged in staggered downward relation, and a plurality of movable members 47*a-j* which are movable reciprocally in relation to the steps 45*a-j* to transfer waste product along and over the steps 45*a-k*.

In this embodiment the steps 45*a-k* are arranged substantially in spaced, parallel relation, and the movable members 47*a-j* are configured such that upper and lower surfaces of the movable members 47*a-j* are in close relation to adjacent surfaces of the steps 45*a-k*, whereby the action of withdrawing the movable members 47*a-j* acts to scrape material therefrom.

In this embodiment the steps 45*a-k* comprise substantially-flat plates.

Figure 3:
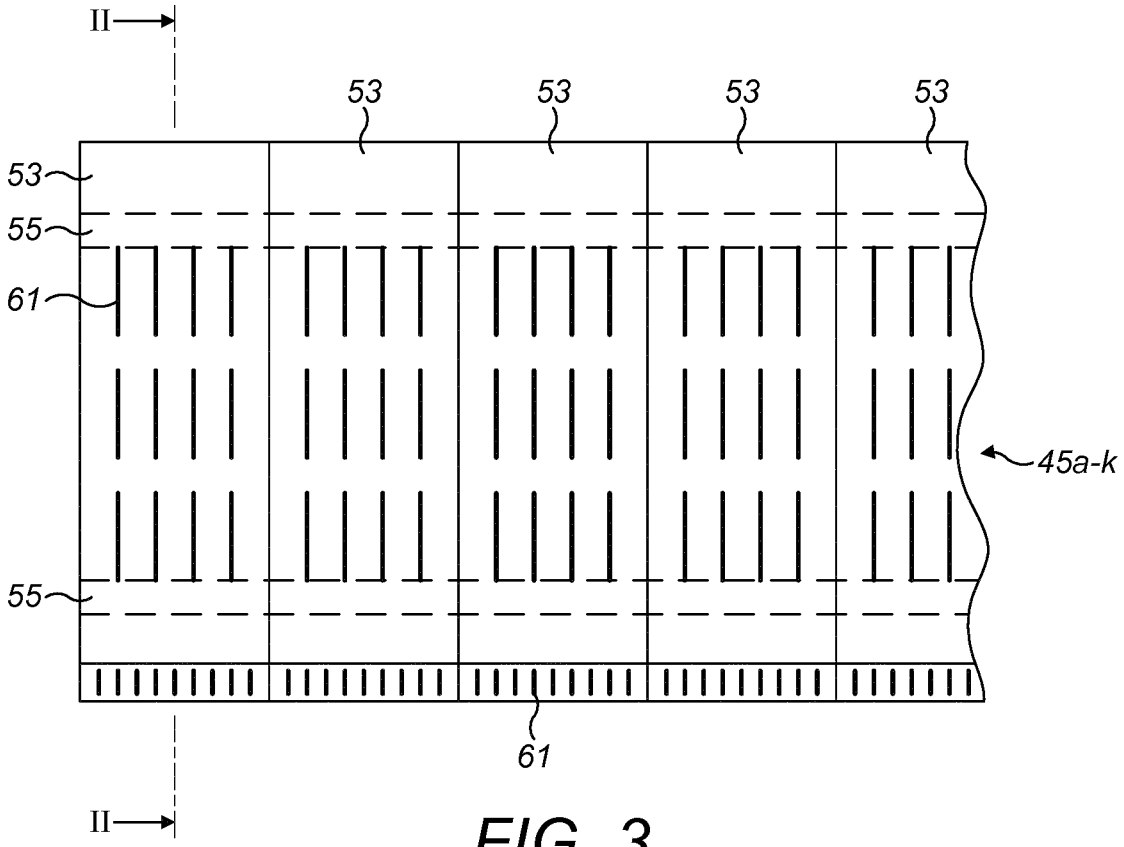
FIG. 3 illustrates a fragmentary plan view of the steps of the transfer mechanism of the system of FIG. 1.

In this embodiment, as illustrated in FIG. 3, the steps 45*a-k* are formed from a plurality of elements 53 which are arranged in adjacent lateral relation.

In this embodiment the elements 53 are supported by at least one support 55, here first and second elongate bars.

Figure 4:
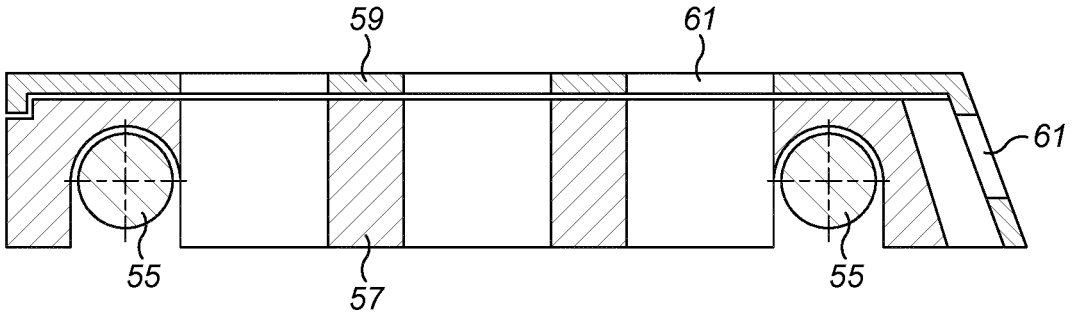
FIG. 4 illustrates a vertical sectional view (along section II-II in FIG. 3) of the step of FIG. 3.

In this embodiment, as illustrated in FIG. 4, the elements 53 each comprise a main body part 57, here formed of nodular or stainless steel, and a cover part 59, here formed of stainless steel, preferably high-chrome, nickel stainless steel, which is located over the main body part 57.

In this embodiment the steps 45*a-k* include apertures 61 through which an air flow can be driven upwardly into the combustion cavity 31.

In this embodiment the apertures 61 comprise slots, but could have other form.

In this embodiment the movable members 47*a-j* comprise substantially-flat plates.

Figure 5:
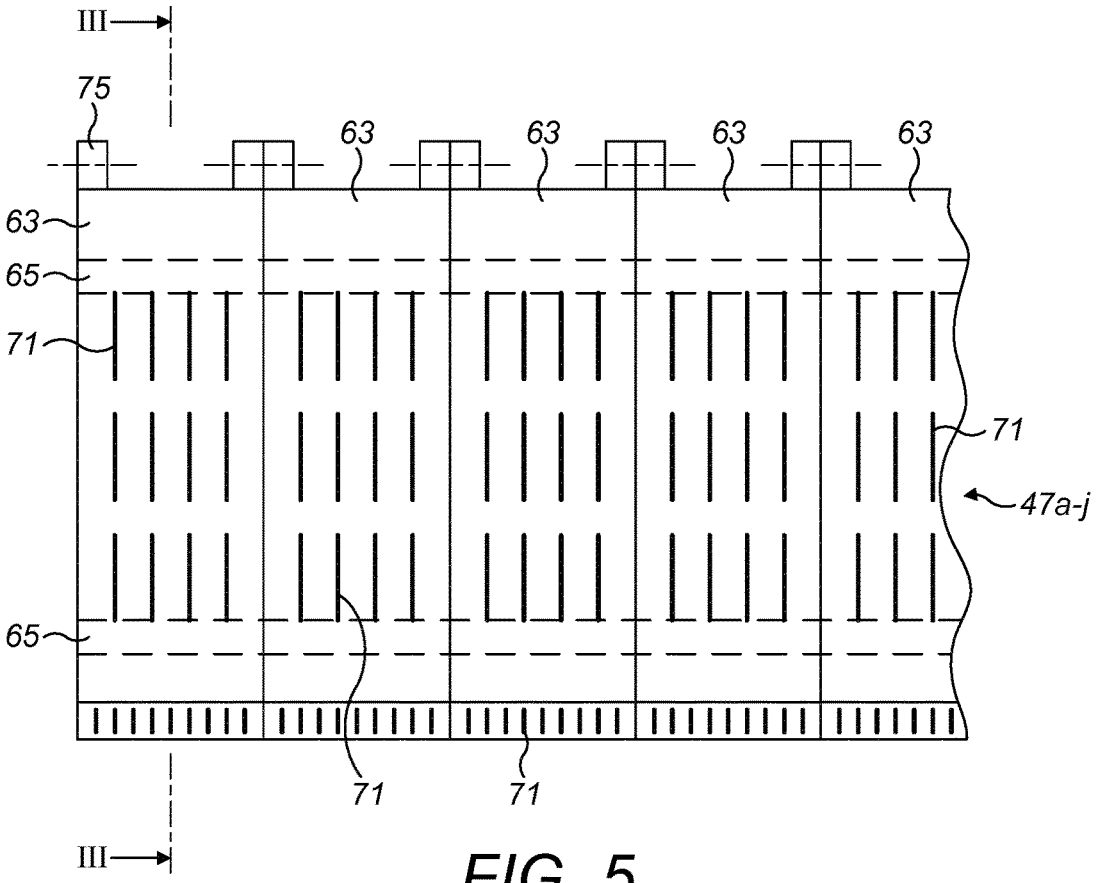
FIG. 5 illustrates a fragmentary plan view of the movable members of the transfer mechanism of the system of FIG. 1.
Figure 6:
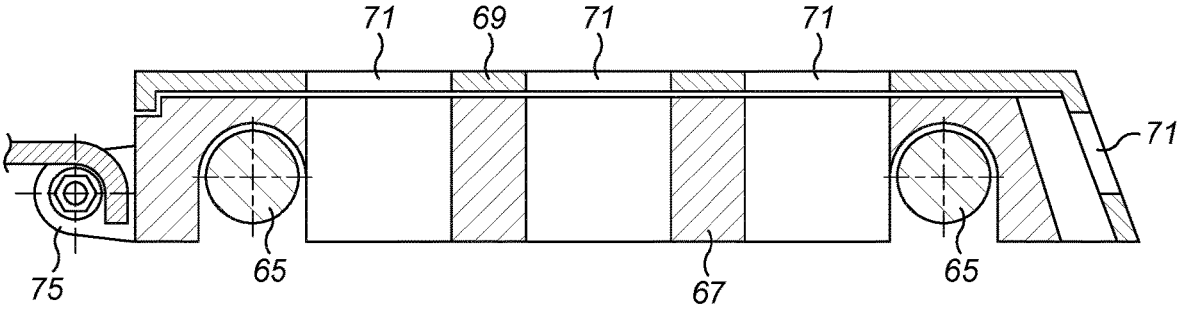
FIG. 6 illustrates a vertical sectional view (along section III-III in FIG. 5) of the movable member of FIG. 5.

In this embodiment, as illustrated in FIG. 5, the movable members 47*a-j* are formed from a plurality of elements 63 which are arranged in adjacent lateral relation.

In this embodiment the elements 63 are supported by at least one support 65, here first and second elongate bars.

In this embodiment, as illustrated in FIG. 5, the elements 63 each comprise a main body part 67, here formed of nodular or stainless steel, and a cover part 69, here formed of stainless steel, preferably high-chrome, nickel stainless steel, which is located over the main body part 67.

In this embodiment the movable members 47*a-j* include apertures 71 through which an air flow is driven upwardly into the cavity 31 of the combustion chamber 9.

In this embodiment the apertures 71 comprise slots, but could have other form.

In this embodiment the apertures 71 comprise narrow slots having a width of from about 1 mm to about 2 mm, which provide for a high exit velocity, here from about 4 m/s to about 6 m/s, which prevents the slagging of waste product.

In this embodiment the movable members 47*a-j* include an attachment 75 to which an actuator (not illustrated) is coupled for moving the movable members 47*a-j*.

In this embodiment ones or groups of ones of the movable members 47*a-j* are movable independently of one another, so as to enable control of an amount of waste product in the combustion zone and hence the rate of burn. This manner of control allows readily for use with different kinds of waste product, which can have different rates of burning, with the rate of transfer being controlled accordingly.

In this embodiment the movable members 47*a-j* are configured in a plurality of groups, here comprising a first group 47*a-c*, a second group 47*d-f*, a third group 47*g-i*, and a fourth group 47*k*.

In this embodiment the air supply unit 43 comprises a plurality of air supplies 81*a-d* which supply air to the combustion chamber 9 from beneath the transfer mechanism 42.

In this embodiment the air supplies 81*a-d* each comprise a channel 83*a-d* which has an upper end 85 which opens to a respective region of the transfer mechanism 33 and a supply port 87*a-d* from which air is delivered from an air source 88.

In this embodiment the channel 83*a-d* has an open lower end 89 which opens to a channel 90 which allows for the collection of ash which falls through the transfer mechanism 42.

In this embodiment the supply ports 85*a-d* are controllable, here valved, to regulate the rate of flow of air from the respective air supplies 81*a-d*.

In this embodiment the floor assembly 32 is integrally formed and the system includes slides 83 on which the floor assembly 32 is slideably disposed, so as to allow easy access to the transfer mechanism 42 and the air supply unit 43.

In this embodiment the combustion chamber 9 further comprises first and second air inlets 91, 92 which are disposed in a downstream region of the cavity 31 of the combustion chamber 9, with the first air inlet 91 being fluidly connected to an ambient air source 93 which supplies heated ambient air and the second air inlet 92 being fluidly connected to an exhaust gas re-circulation unit 95 which supplies exhaust gas of reduced temperature, and the ambient air source 93 and the exhaust gas re-circulation unit 95 are controlled to temper the temperature of the gas stream, here to a temperature of less than 600 C.

In this embodiment the exhaust gas has a temperature of less than about 180 C.

By tempering the temperature of the gas stream, here to a temperature of less than 600 C, microscopic particles in the exhaust gas, such combustion salts or tar, are converted to ash, so preventing adhesion of these particles to the downstream heat exchanger 96.

Also, by introducing an amount of exhaust gas into the combustion chamber 9, NOx emissions can be regulated to comply with environmental regulations.

In this embodiment the combustion chamber 9 is controlled such that a temperature of about 1200 C is maintained in the combustion zone at the at least one stepped assembly 44, and such that any material which passes from the combustion chamber 9 has a retention time of greater than 2 s at a temperature of greater than 850 C.

In this embodiment the combustion chamber 9 includes at least one burner 87 for igniting the waste product.

In this embodiment the heat exchanger unit 12 comprises a first, main heat exchanger 96 which is disposed in the post-combustion chamber 11, and a second heat exchanger 97 which is fluidly connected to the vents 27 in the pre-heating chamber 7.

In this embodiment the second heat exchanger 97 utilizes the heat of the gas stream which is vented through the vents 27 to pre-heat a fluid medium, typically from a temperature of about 70 C to a temperature of about 180 C, and the first, main heat exchanger 96 receives the heated fluid medium from the second heat exchanger 97 and utilizes the gas stream which passes through the post-combustion chamber 11 to superheat the fluid medium, typically to a temperature of about 600 C, which is then used to drive one or more steam generators (not illustrated) to generate power, typically electricity using electrical generators.

In this embodiment the system further comprises a particulate trap 99 which traps particulate material which is in the gas stream leaving the combustion chamber 9 upstream of the first heat exchanger 96, so as to prevent fouling of the first heat exchanger 96.

Finally, it will be understood that the present invention will be described in its preferred embodiments and can be modified in many different ways without departing from the scope of the present invention as defined by the appended claims.

For example, in one embodiment, where the waste product is "dry", that is, has a moisture level which is less than a predetermined threshold, typically 10 wt %, the pre-heating chamber 7 can be omitted.

The invention claimed is:

1. A combustion kiln system, comprising:

a pre-heating chamber which pre-heats supplied waste product; and a combustion chamber which receives the pre-heated waste product from the pre-heating chamber and in which the pre-heated waste product is incinerated;

wherein the pre-heating chamber comprises a cavity through which the supplied waste product is displaced and includes a plurality of air inlets which feed heated air into the cavity of the pre-heating chamber and a plurality of vents through which a gas stream is vented, whereby the pre-heating chamber heats the supplied waste product prior to transfer to the combustion chamber, and wherein the combustion chamber comprises a cavity, a transfer mechanism which provides a grate at a floor of the combustion chamber and transfers the pre-heated waste product through a combustion zone, and a plurality of air supplies which supply air to the cavity of the combustion chamber.

2. The system of claim 1, wherein the cavity of the combustion chamber is lined at least on opposite side walls thereof with heat-resistant plates.

3. The system of claim 2, wherein the plates include air-cooling apertures for delivery of a supply of air over a facing surface thereof, so as to generate air flows at the opposite side walls of the cavity of the combustion chamber.

4. The system of claim 1, wherein the transfer mechanism comprises at least one stepped assembly over which the pre-heated waste product can be transferred.

5. The system of claim 4, wherein the transfer mechanism comprises first and second stepped assemblies which are arranged in adjacent, parallel relation.

6. The system of claim 4, wherein the at least one stepped assembly comprises a plurality of steps which are arranged in downwardly-descending relation, and a plurality of movable members which are movable reciprocally in relation to the steps to transfer the pre-heated waste product along and over the steps.

7. The system of claim 6, wherein the steps are arranged in spaced, parallel relation, and the movable members are configured such that upper and lower surfaces of the members are in close relation to adjacent surfaces of the steps, whereby an action of withdrawing the movable members can act to scrape the pre-heated waste product therefrom.

8. The system of claim 6, wherein the steps are formed from a plurality of elements which are arranged in adjacent lateral relation.

9. The system of claim 6, wherein the steps include apertures through which an air flow can be driven upwardly into the cavity of the combustion chamber.

10. The system of claim 1, further comprising:

a heat exchanger unit configured to be heated at least by heated gas from the combustion chamber to provide a heated fluid medium.

11. The system of claim 1, further comprising:

a waste product supply for supplying the supplied waste product to the pre-heating chamber.

12. A method of incinerating waste product, comprising the steps of:

pre-heating supplied waste product in a pre-heating chamber; wherein the pre-heating chamber comprises a cavity through which the supplied waste product is displaced and includes a plurality of air inlets and a plurality of vents through which a gas stream is vented;

feeding heated air into the cavity of the pre-heating chamber through the air inlets:

transferring the pre-heated waste product from the pre-combustion chamber to a cavity of a combustion chamber, wherein the pre-heated waste product is transferred through a combustion zone by a transfer mechanism which provides a grate at a floor of the combustion chamber;

supplying air into the cavity of the combustion chamber through a plurality of air supplies; and incinerating the pre-heated waste product in the combustion chamber;

wherein the pre-heating chamber heats the supplied waste product to remove moisture from the supplied waste product prior to transfer to the combustion chamber, with a temperature within at least an upstream region of the cavity of the pre-heating chamber being maintained at a temperature of less than 600° C., such that moisture is removed from the supplied waste product without causing release of chlorides from the supplied waste product.

13. The method of claim 12, wherein the supplied waste product is municipal solid waste (MSW), processed waste or refuse-derived waste (RDF).

* * * * *